US006261068B1

(12) United States Patent
Kramer et al.

(10) Patent No.: US 6,261,068 B1
(45) Date of Patent: Jul. 17, 2001

(54) GAS COMPRESSOR

(75) Inventors: Manfred Kramer, Barsinghausen; Heinrich Schlossarczyk, Wennigsen; Karl-Heinrich Schönfeld, Seelze, all of (DE)

(73) Assignee: Wabco GmbH, Hannover (DE)

( * ) Notice: Subject to any disclaimer, the term of this patent is extended or adjusted under 35 U.S.C. 154(b) by 0 days.

(21) Appl. No.: 09/416,166

(22) Filed: Oct. 11, 1999

(30) Foreign Application Priority Data

Oct. 20, 1998 (DE) ..... 198 48 217

(51) Int. Cl.[7] ..... F04B 49/00; F04B 23/00; F04B 3/00

(52) U.S. Cl. ..... 417/297; 298/251; 298/440; 298/441

(58) Field of Search ..... 417/297, 298, 417/251, 440, 441

(56) References Cited

U.S. PATENT DOCUMENTS

| | | | | |
|---|---|---|---|---|
| 3,836,288 | * | 9/1974 | Evans | 417/307 |
| 4,756,548 | * | 7/1988 | Kaltenthaler et al. | 280/702 |
| 4,809,957 | * | 3/1989 | Schonfeld et al. | 267/64.11 |
| 5,101,857 | | 4/1992 | Heger et al. | 137/599 |
| 5,503,537 | | 4/1996 | Schlossarczyk et al. | 417/296 |
| 5,860,800 | * | 1/1999 | Kramer et al. | 417/571 |

FOREIGN PATENT DOCUMENTS

| | | | |
|---|---|---|---|
| 32 11 598 A1 | | 11/1983 | (DE) . |
| 3637741 | * | 12/1990 | (DE) . |
| 3919438 | * | 12/1990 | (DE) . |
| 43 21 019 A1 | | 1/1995 | (DE) . |
| 197 45 118 A1 | | 4/1999 | (DE) . |

* cited by examiner

*Primary Examiner*—Timothy S. Thorpe
*Assistant Examiner*—Michael K. Gray
(74) *Attorney, Agent, or Firm*—Proskauer Rose LLP

(57) ABSTRACT

A gas compressor includes a compression chamber, an outlet valve, and a shuttle valve which disables the outlet valve when it is connected to an atmospheric pressure relief chamber in idle operation. A throttle line circumventing the shuttle valve is provided which permits by-passed flow between the compression chamber and the atmospheric pressure relief chamber in idle operation, thereby preventing deposits and moisture condensation in the downstream flow path to the pressure relief chamber due to the disabling of the outlet valve, which might otherwise lead to possible operational malfunctions. Compressed-air systems employed in the automotive industry represent an important area of application for the invention.

8 Claims, 3 Drawing Sheets

GAS COMPRESSOR

BACKGROUND OF THE INVENTION

The invention relates to a gas compressor of the type which is switchable between operation under load and idle operation, and more particularly, to a gas compressor in which an outlet valve is connected to a pressure relief chamber during idle operation.

A gas compressor of this type is disclosed, for example, in German Patent DE 43 21 013 A1 (corresponding to U.S. Pat. No. 5,503,537, which is incorporated herein by reference). The compressor includes a compression chamber which is connected via a shuttle valve to an additional compression chamber in idle operation. Such design causes an idle self-stabilization pressure to build up in the compression chamber and in the additional compression chamber during idle operation, resulting in the elimination or reduction of the gas compressor's oil consumption.

The output quantity of such a gas compressor is controlled by means of a pressure regulator, used alone, or together with other control devices. In idle operation, the pressure regulator disconnects the output of the outlet valve of the gas compressor from the pressure system to be supplied and connects this output to a pressure relief chamber which is under atmospheric pressure. The pressure regulator is normally installed in a line system interconnecting the outlet valve with the pressure system or the pressure relief chamber.

In order for a build-up of pressure in the above-mentioned compression chambers to be rendered at all possible while in idle operation, the outlet valve must be disabled in idle operation. This is effected by a first shuttle valve. Furthermore, the first shuttle valve allows the gas compressor to operate with pre-compressed gas. Such applications are common in the automotive industry, in which air is the gas used. In this technical field, the usual practice is to feed the air to be compressed to the gas compressor from the suction line of the combustion drive engine. To increase the engine output, the air fed to the engine, and thereby also to the compressor through the suction line, is often pre-compressed (super-charged). The gas used in other technical fields is also mainly air. In such cases where air is the gas used, the atmosphere generally serves as the pressure relief chamber.

As a consequence of disabling the outlet valve in idle operation, no flow takes place in idle operation between the compression chamber and the pressure relief chamber. This lack of flow may lead to an accumulation of pollutants and liquid from the gas, as well as to freezing, and may thereby contribute to malfunctions in the components which are between the compression chamber and the pressure relief chamber, such as the outlet valve, lines, and pressure regulator.

It is therefore the object of the invention to further develop a gas compressor of the type mentioned above in a simple manner such that malfunctions caused by disabling the outlet valve may be avoided.

SUMMARY OF THE INVENTION

In accordance with these and other objects of the invention, there is provided a gas compressor switchable between operation under load and idle operation. The gas compressor includes one or more compression chambers, each including at least one outlet valve. An atmospheric pressure relief chamber is provided, each outlet valve being connected to the atmospheric pressure relief chamber in idle operation of the gas compressor. A first shuttle valve, which is closed during idle operation, is disposed upstream of the outlet valve. The gas compressor further includes an additional compression chamber for each compression chamber, the additional compression chamber being connected with the corresponding compression chamber during idle operation. In accordance with the invention, at least one throttle line is provided for each compression chamber, arranged in a manner such that the throttle line circumvents the first shuttle valve in idle operation of the gas compressor. The invention thereby effectively reduces or prevents deposits and moisture condensation in the downstream flow path to the pressure relief chamber due to the disabling of the outlet valve by closure of the first shuttle valve.

The invention, as disclosed herein, can be used for all suitable types of gas compressors.

In accordance with gas compressors of the prior art, the lower the desired idle self-stabilization pressure, the greater the required size of the additional compression chamber. Due to the permissible outflow through the throttle line, the invention demonstrates a tendency for a lowering of this self-stabilization pressure. The invention therefore makes it possible to reduce the required size of the additional compression chamber for a desired value of the idle self-stabilization pressure, and thereby often to reduce the space requirement for the compressor.

The above, and other objects, features and advantages of the present invention will become apparent from the following description read in conjunction with the accompanying drawings, in which like reference numerals designate the same elements.

DETAILED DESCRIPTION OF A PREFERRED EMBODIMENT

Figure 1:
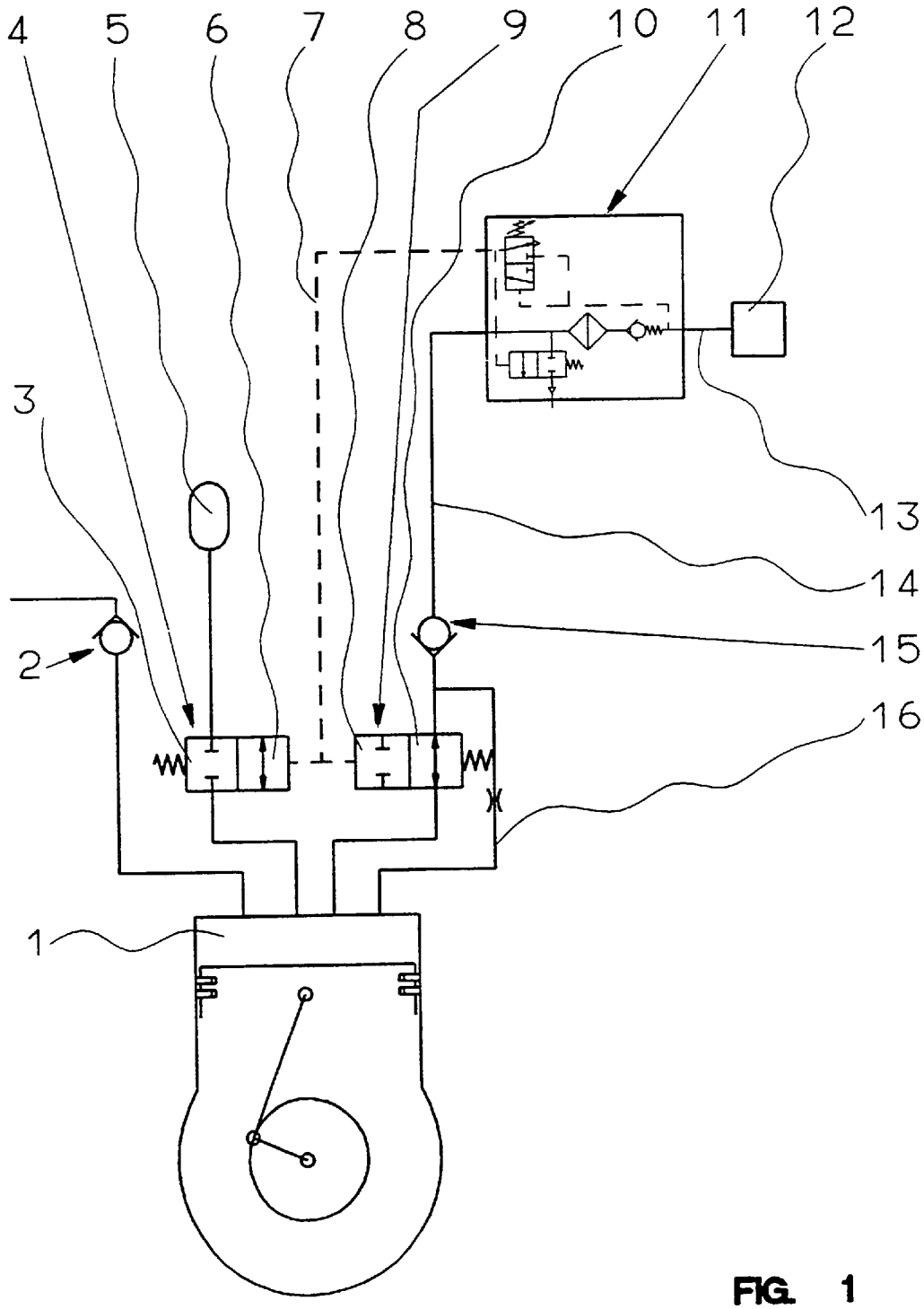
FIG. 1 is a schematic representation of a cylinder of a gas compressor in accordance with an embodiment of the invention.

Referring now to the figures, and in particular, FIG. 1, a cylinder, or one of several cylinders, of a gas compressor of the piston type is depicted schematically. Constructed in general accordance with the known compressor disclosed in the above referred German patent DE 43 21 013 A1, each such cylinder comprises a compression chamber 1, an inlet valve 2, an outlet valve 15, an additional compression chamber 5 and two shuttle valves 4 and 9. In addition, and as distinguished from the prior art compressor, the gas compressor depicted further includes a throttle line 16.

Each valve shown may be the only actually one provided, or may alternatively represent several of a same type. The first shuttle valve 9 is located upstream of the outlet valve 15, in a connection between the compression chamber 1 and the outlet valve 15. The second shuttle valve 4 is located in a connection between the compression chamber 1 and the additional compression chamber 5. The throttle line 16 extends from the compression chamber 1 to the inlet of the outlet valve 15, thus circumventing the first shuttle valve 9.

An outlet line 13, 14 extends from the outlet valve 15 to the pressure system 12 to be supplied by the gas compressor, within which a pressure regulator 11 is provided. The pressure regulator 11 ensures the switching of the gas compressor between operation under load and idle operation. When the gas compressor is under load, the pressure regulator 11 is open to flow, and when the gas compressor is in idle operation, the pressure regulator 11 connects the segment 14 of the outlet line 13, 14, leading from the outlet valve 15, to the atmosphere. The gas compressor depicted is therefore operated with air as the gas.

The pressure system 12 is shown schematically in the form of a box. All mentioned valves and the pressure regulator are represented with basic symbols and function symbols according to the international standard ISO 1219. The design and construction of such valves are known to the person schooled in the art or can be readily produced by such skilled artisan.

The shuttle valves 4 and 9 are controlled by pressure. Their control devices are connected to a control line 7 leading from the pressure regulator 11, represented in the figure by broken lines. During operation under load, the control line 7 is connected to atmosphere via the pressure regulator while it is under pressure during idle operation. During operation of the gas compressor under load, the first shuttle valve 9 is in an open position 10 and the second shuttle valve 4 is in a closed position 3. As a result, when the gas compressor runs under load, the air compressed by the gas compressor is permitted to flow through the first shuttle valve 9 and the outlet valve 15, through the pressure regulator 11, and into the pressure system 12, while flow between the compression chamber 1 and the additional compression chamber 5 is prohibited.

During idle operation of the gas compressor, the pressure transmitted by the pressure regulator 11 into the control line 7 causes the first shuttle valve 9 to assume a closed position 8, and the second shuttle valve 4 an open position 6. As a result, the flow required for the build-up of an idle self-stabilizing pressure is allowed to occur between the compression chamber 1 and the additional compression chamber 5 in this operating mode, while only a minimal outflow through the outlet valve 15 takes place due to the dimensions of the throttle line 16. This reduced outflow is sufficient, however, to carry pollutants and liquid condensation on its path of flow from the compression chamber 1, through the outlet valve 15 and the pressure regulator 11, to the outlet into the atmosphere, and thus operates to prevent malfunctions caused by such influences. The outflow through the throttle line 16 results in a lowering of the idle self-stabilizing pressure for a given size of the additional compression chamber 5. However, such effect can easily be compensated for by reducing the size of the additional compression chamber 5. As a rule, such a reduction in size is advantageous because it also makes possible a reduction of the space requirement of the gas compressor. The throttle line 16 provides further advantage in that it can be given different dimensions such that an adjustment of the idle self-stabilizing pressure, especially to effect a lowering thereof, is made possible within certain limits and for a given additional compression chamber 5.

Figure 2:
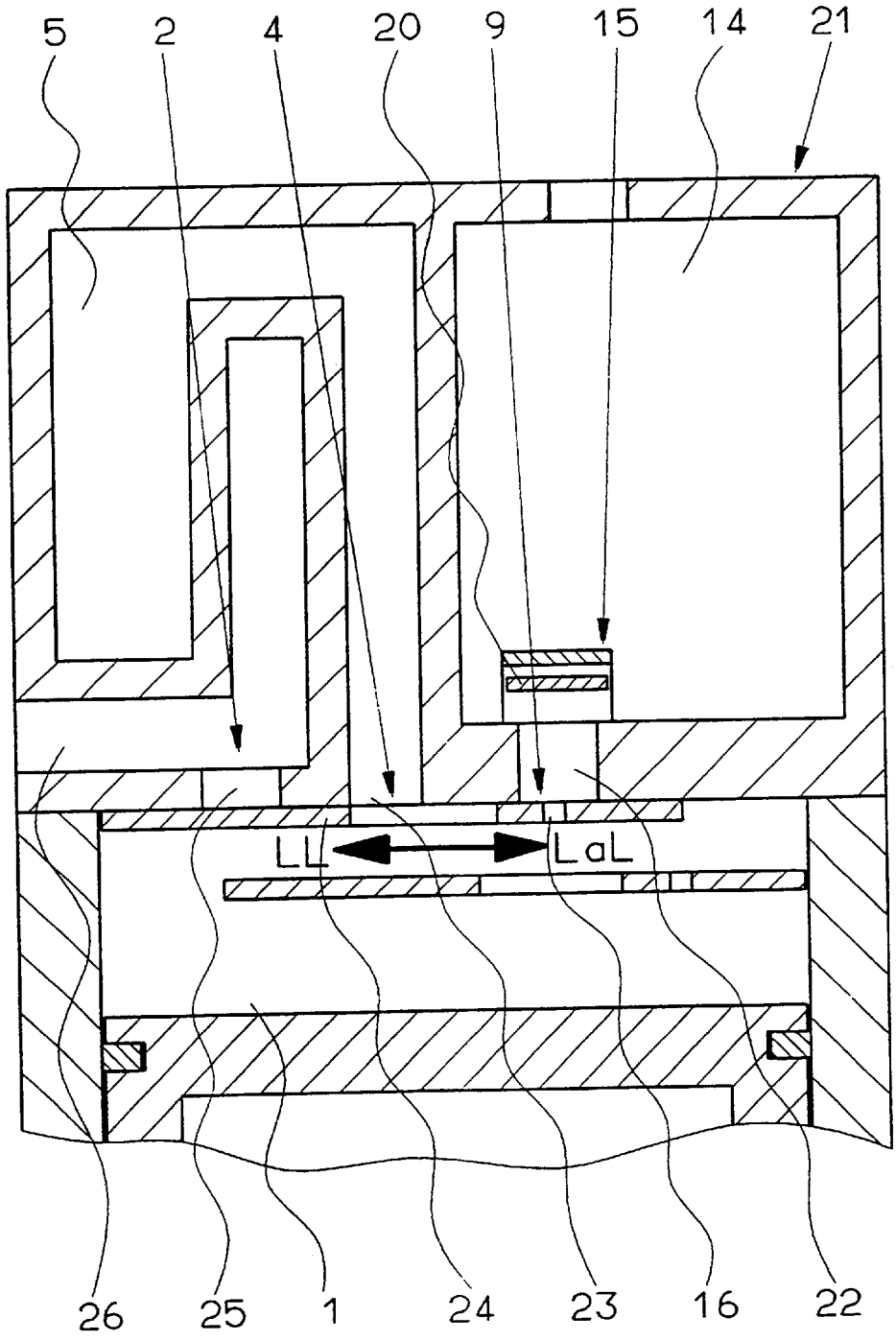
FIG. 2 is a detailed view of an embodiment of a cylinder head incorporating components shown schematically in FIG. 1.

Referring now to FIG. 2, a detailed view of an embodiment of components which are shown schematically in FIG. 1 is depicted.

The additional compression chamber 5, the beginning of the segment 14 of the outlet line widened into an outlet chamber going to the pressure regulator, and the end of an inlet line widened into an inlet chamber 26, are united in a cylinder head, generally designated by the reference number 21.

The outlet valve 15 includes a lamellar valve element 20 which, together with the opening of a passage 22 on the side of the outlet chamber, constitutes the outlet valve 15 between the outlet chamber and the compression chamber 1.

The inlet valve 2, the first shuttle valve 9 and the second shuttle valve 4 employ a common valve element 24. The valve element 24 is provided in the form of a lamella and can be displaced and/or swivelled between an idle position LL and a load operation position LaL by a pressure-dependent actuating device (not shown). When it is displaced and/or swivelled, the valve element 24 glides on the surface of the cylinder head 21 facing the compression chamber 1.

The pressure-dependent actuating device constitutes a common pressure control device for the shuttle valves. Such actuating devices are known, for example, from German patent application DE 39 04 172 A1 (corresponding to U.S. Pat. No. 5,101,857, which is incorporated herein by reference).

The valve element is shown, in FIG. 2, at the top in its idle position LL and below, suspended in the compression chamber 1, in its load operation position under load LaL. The valve element 24, together with the outlet of the passage 22 on the side of the compression chamber, constitutes the first shuttle valve 9. The valve element 24, together with the outlet of a passage 25 between the inlet chamber 26 and the compression chamber 1 on the side of the compression chamber, constitutes the inlet valve 2. The valve element 24, together with the outlet of a passage 23 between the additional compression chamber 5 and the compression chamber 1 on the side of the compression chamber, constitutes the second shuttle valve 4. For such purposes, the valve element 24 is provided with a closed area which is positioned and designed so that it covers the passages 22 and 25 when the valve element 24 is in idle position LL and covers the passages 23 and 25 when the valve element 24 is in load operation position LaL. The closed area surrounds an open area which is placed and designed such that it completely or partially frees the passage 23 when the valve element 24 is in idle position LL, and completely or partially frees the passage 22 when the valve element 24 is in load operation position LaL. Said Valve functions result from the above-described arrangements and designs of the closed area and of the open area, as well as from the elasticity of the valve element 24. The elasticity is significant insofar as it allows for the opening of the inlet valve 2 even though the passage 25 is covered as a result of the excess pressure in the inlet chamber 26 during the suction stroke of the piston. The throttle line 16 is provided in the form of an opening in the portion of the closed area of the valve element 24 which covers the passage 22 when the valve element 24 is in its idle position LL. With this design, the throttle line 16 is closed when the valve element 24 is in load operation position LaL, and the gas compressor is correspondingly in load operation. In this respect, the arrangement of the throttle line 16 differs from the arrangement according to FIG. 1.

In a manner not specifically shown herein, the throttle line may also be constituted in a manner such that the closed area of the valve element 24 is placed and designed such that it does not cover the passage 22 completely when the valve element 24 is in its idle position LL, but leaves a gap open which constitutes the throttle line.

In this embodiment, and again representing a deviation from FIG. 1, the throttle line is totally absent when the valve element 24 is in its load operation position LaL, and thereby when the gas compressor is also in load operation.

The above-mentioned deviations from the throttle line 16 of FIG. 1 are however without any importance in affecting intended operation.

Figure 3:
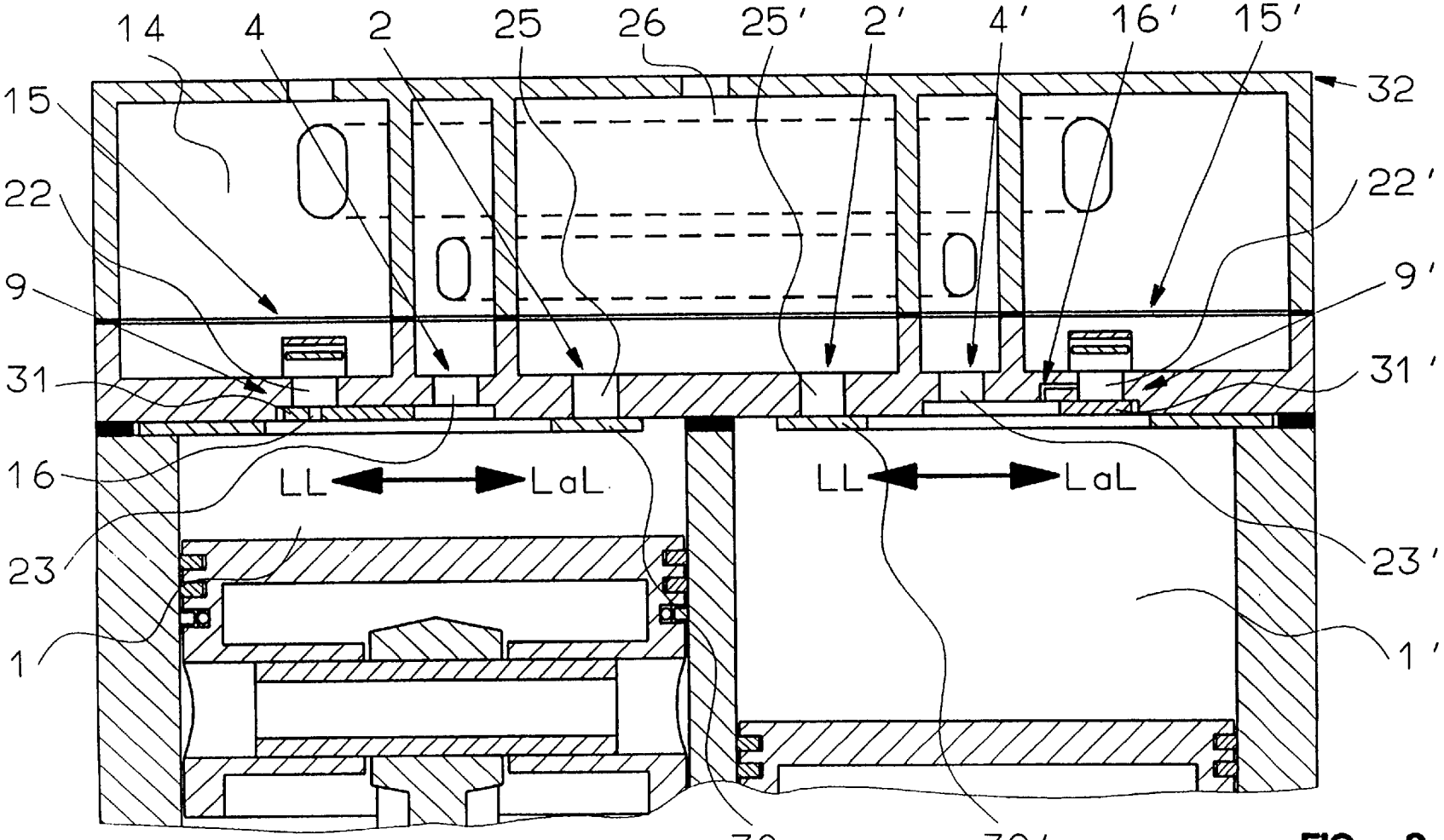
FIG. 3 is a detailed view of an embodiment of a two-cylinder gas compressor of piston construction incorporating components shown schematically in FIG. 1.

Turning now to FIG. 3, other embodiments of components according to FIGS. 1 and 2 are shown by way of an example of a two-cylinder gas compressor of piston construction. Components having the same functions as in FIGS. 1 and 2 are given the same reference symbols and can be furthermore recognized on the cylinder shown on the right by means of prime designations. In the depicted example, the compression chamber 1' or 1 of one cylinder, together with a connection channel which is not described in further detail in the cylinder head, serves as the additional compression chamber of the other cylinder.

As shown in FIG. 3, the passages of the connection channel represent the passages 23, 23' between the respective additional compression chamber and the respective compression chamber 1, 1'. The shuttle valves 4, 9 or 4', 9' of each cylinder have a common valve element 31, 31', while each of the inlet valves 2, 2' is formed by its own valve element 30, 30'. The valve elements are again lamellar.

The inlet valve elements 30, 30' can neither be displaced nor swivelled relative to their respectively assigned passage 25 or 25'. In the depicted example, they are clampingly held for such purpose between the cylinder head 32 and the cylinder housing, but may also be attached by any other practical means.

The outlets on the compression chamber side of the passages 23, 22 or 23', 22' assigned to the shuttle valves 4, 9 or 4', 9' of each cylinder are located on a surface of the cylinder head 32 which is offset across from the respective outlet of the passage 25 or 25' on the compression chamber side. The shuttle valve elements 31, 31' are guided between the offset surface and the applicable inlet valve element 30, 30' as they are displaced and/or swivelled.

The inlet valve elements 30, 30' are cut out in the area of their respectively assigned shuttle valves 4, 9 or 4', 9', thus permitting proper functioning thereof.

With regard to the cylinder drawn on the left side, the throttle line 16 is in the form of an opening in the shuttle valve element 31, in conformance with the design of FIG. 2. In the cylinder depicted on the right side of the figure, the throttle line 16' is shown in a housing part, whereby the cylinder head 32 forms this housing part. This illustrates another possible implementation solution. In this embodiment, the throttle line 16' is always open, with the exception of a brief closure when the shuttle valve element 31' is displaced and/or swivelled between load operation position LaL and idle position LL. This design thus corresponds in function to the one shown in FIG. 1. The throttle line 16' may, however, also be closed without affecting the operation of the gas compressor when the shuttle valve element 31' is in the load operation position LaL.

The explanations applicable to one figure also apply generally to the remaining figures, directly or in corresponding application, to the extent that the above details are not in conflict with one another.

Having described preferred embodiments of the invention with reference to the accompanying drawing, it is to be understood that the invention is not limited to those precise embodiments, and that various changes and modifications may be effected therein by one skilled in the art without departing from the scope or spirit of the invention as defined in the appended claims. This contemplated scope of protection includes, in particular, the design of valves using valve elements other than in lamellar form.

What is claimed is:

1. A gas compressor switchable between operation under load and idle operation, comprising:

a compression chamber, said compression chamber being connected to an outlet valve;

said outlet valve being connected to an atmospheric pressure relief space in idle operation;

a first shuttle valve upstream of said outlet valve and positioned between said compression chamber and said outlet valve, said first shuttle valve being closed during idle operation;

an additional compression chamber;

a second shuttle valve position between said additional compression chamber and said compression chamber, said second shuttle valve connecting said additional compression chamber and said compression chamber in idle operation, said second shuttle valve and said first shuttle valve being in communication with a pressure control device;

a throttle line being provided for said compression chamber, said throttle line circumventing the first shuttle valve in idle operation such that in idle operation said compression chamber directly connects to said outlet valve.

2. A gas compressor according to claim 1, wherein the first shuttle valve includes a valve element controlling flow through the first shuttle valve, the throttle valve being defined by a structural portion of said valve element.

3. A gas compressor according to claim 2, wherein said valve element is a lamellar element, said lamellar element including an opening therein defining said throttle line.

4. A gas compressor according to claim 1, further comprising a housing, said throttle line being installed in said housing.

5. A gas compressor according to claim 1, further comprising a housing, said throttle line being installed inside said housing on a cylinder head.

6. A gas compressor according to claim 1, wherein the throttle line circumvents the first shuttle valve exclusively in idle operation.

7. A gas compressor according to claim 1, wherein the throttle line circumvents the first shuttle valve both in operation under load and in idle operation.

8. A gas compressor according to claim 1, said first shuttle valve and said second shuttle valve include a common valve element for controlling flow therethrough.

* * * * *

UNITED STATES PATENT AND TRADEMARK OFFICE

CERTIFICATE OF CORRECTION

PATENT NO. : 6,261,068 B1
DATED : July 17, 2001
INVENTOR(S) : Manfred Kramer et al.

It is certified that error appears in the above-identified patent and that said Letters Patent is hereby corrected as shown below:

Title page,
Item [75], Inventors, -- Folkhard Hölzel -- should be added.

Signed and Sealed this

Thirteenth Day of May, 2003

JAMES E. ROGAN
*Director of the United States Patent and Trademark Office*